US007617869B2

(12) United States Patent
Carney et al.

(10) Patent No.: US 7,617,869 B2
(45) Date of Patent: Nov. 17, 2009

(54) METHODS FOR EXTRACTING OIL FROM TAR SAND

(75) Inventors: Peter R. Carney, Lake Forest, IL (US); Igor V. Barsukov, Glenview, IL (US); Frank Wawzros, McHenry, IL (US); Jeff Radford, Hopkinsville, KY (US)

(73) Assignee: Superior Graphite Co., Chicago, IL (US)

( * ) Notice: Subject to any disclaimer, the term of this patent is extended or adjusted under 35 U.S.C. 154(b) by 187 days.

(21) Appl. No.: 11/671,135

(22) Filed: Feb. 5, 2007

(65) Prior Publication Data

US 2008/0185145 A1 Aug. 7, 2008

(51) Int. Cl.
*E21B 43/24* (2006.01)
*E21B 36/04* (2006.01)
*E21B 43/30* (2006.01)

(52) U.S. Cl. ..... 166/248; 166/245; 166/302

(58) Field of Classification Search ..... 166/60, 166/302, 248, 272.1, 245, 65.1; 392/306
See application file for complete search history.

(56) References Cited

U.S. PATENT DOCUMENTS 2,670,802 A * 3/1954 Ackley ..... 166/401
3,823,777 A 7/1974 Allen et al.
3,948,319 A * 4/1976 Pritchett ..... 166/248
3,958,636 A * 5/1976 Perkins ..... 166/248
4,008,764 A 2/1977 Allen
4,067,391 A 1/1978 Dewell
4,135,579 A 1/1979 Rowland et al.
4,140,180 A 2/1979 Bridges et al.
4,144,935 A 3/1979 Bridges et al.
4,193,451 A 3/1980 Dauphine
4,223,728 A 9/1980 Pegg
4,265,307 A 5/1981 Elkins
4,301,865 A 11/1981 Kasevich et al.
4,344,485 A 8/1982 Butler
4,376,598 A 3/1983 Brouns et al.
4,379,592 A 4/1983 Vakhnin et al.
4,385,662 A 5/1983 Mullins et al.
4,396,062 A 8/1983 Iskander
4,410,216 A 10/1983 Allen
4,434,852 A 3/1984 Morel et al.
4,501,326 A 2/1985 Edmunds
4,598,770 A 7/1986 Shu et al.
4,651,825 A * 3/1987 Wilson ..... 166/245
4,687,058 A 8/1987 Casad et al.
4,794,987 A 1/1989 Kokolis et al.
4,834,179 A 5/1989 Kokolis et al.
4,926,941 A * 5/1990 Glandt et al. ..... 166/248
4,956,535 A 9/1990 Buelt et al.
5,065,821 A 11/1991 Huang et al.
5,148,869 A 9/1992 Sanchez
5,273,111 A 12/1993 Brannan et al.
5,510,033 A * 4/1996 Ensley et al. ..... 210/611
6,948,563 B2 9/2005 Wellington et al.

* cited by examiner

*Primary Examiner*—Giovanna C Wright
(74) *Attorney, Agent, or Firm*—Cook Alex Ltd.

(57) ABSTRACT

Hydrocarbon containing formations can be processed using an in-situ liquefaction technique. This new technique embodies systematic temperature elevation applied to subsurface formation allowing recoverable hydrocarbons to reach a Newtonian fluid viscosity suitable for extraction.

24 Claims, 5 Drawing Sheets

METHODS FOR EXTRACTING OIL FROM TAR SAND

BACKGROUND OF THE INVENTION

Tar sands deposits are found throughout the world, with large deposits being located in Venezuela and Alberta, Canada. The estimated reserves of petroleum oil in these deposits is believed to be account for 66% of the world supply, with the Venezuelan Orinoco tar sands deposit containing an estimated 1.8 trillion barrels of oil, and Canada's Athabasca tar sands deposit in Alberta containing an estimated 1.75 trillion barrels.

While conventional crude oil can be typically pumped from under the ground or flow naturally, tar sands must be mined or heated in-situ in order to recover the hydrocarbons. It is estimated that 80% of the Alberta oil sands are too far below the surface for open pit mining, so other techniques must be used to recover the oil. One such conventional in-situ mining technique is referred to as Steam-Assisted Gravity Drainage (SAGD). The process involves massive injections of steam into a deposit, where it condenses into hot water. The hot water is mixed with the tar sand to create a hydrocarbon slurry. The hydrocarbon slurry flows to a collector bore at the base of the zone, from which it is pumped to the surface and then piped to an extraction plant, where it is agitated and the oil is skimmed from the top. Major disadvantages of this process include the need for extensive water supplies and abundant energy (natural gas) to boil the water, as well as significant wastewater disposal problems.

Accordingly, it is an object of the present invention to provide a method for recovering the oil in tar sand deposits that doesn't have the disadvantages of the SAGD technique described above.

SUMMARY OF THE INVENTION

This object, as well as others, that will become apparent upon reference to the following detailed description and accompanying drawings, are achieved by a method for resistively heating subsurface tar sand formations by supplying electrical current into it. The energy is preferably transferred to the formation via graphitic, partially graphitized and non-graphitic carbonaceous materials forming electrodes, while the process takes advantage of the inherent resistance of the tar sands to generate heat. While the electrodes are preferably used as heating elements, the electrical resistance of the tar sands formation may also be used to generate heat.

In keeping with one aspect of the invention, graphitic, partially graphitized and non-graphitic carbonaceous materials are preferably used as materials for construction of the in-situ liquefaction conductors. The conductive media may include, but is not limited to one or more of:

a) Natural crystalline flake graphite.
b) Partially graphitized cokes (such as Desulco® 9001), Resilient Graphitic Carbons (RGC grades), acetylene coke-based grades and fluid coke based grades).
c) Calcined coke
d) Green coke.
e) Brown and anthracite coal.
f) Carbon black and partially graphitized carbon black (such as PUREBLACK® Carbon available from the Superior Graphite Co.).
g) Synthetic, vein, and amorphous graphite.
h) Synthetic graphite electrodes and shapes'.
i) Coal Tar, Petroleum and mesophase pitch—based chemistries.

j) Expanded graphite-based products
k) Conductive materials of non-carbonaceous nature selected from one or more of the following metals, metal-based alloys, composites and blends and combinations thereof.

Conductive materials to be used preferably exhibit electrical resistivity values in the range of $1\times10^{-3}$ Ω·m through $1\times10^{-8}$ Ω·m, as determined by using a 4-point resistivity tester.

In one aspect of the invention, conductive carbon and non-carbon-based conductors may be formed from a compacted bed of powdered and/or granular materials inside the boreholes. The boreholes preferably measure from 1.5"(3.8 cm) to 20" (50.8 cm) in diameter.

In another aspect of the invention, conductive carbon and non-carbon-based conductors may be formed from graphite electrodes measuring in a diameter range from 8"(20.3 cm) to 20"(50.8 cm).

Alternatively, conductive carbon and non-carbon-based conductors may be formed from graphite electrodes that are smaller in diameter than the borehole, with the area around the electrode being packed with one or more materials described above.

In another aspect of the invention, the angle of repose of the conductive material can be a significant parameter in evaluating whether the powdered and/or granular conductive materials are suitable for the present invention. Conductive materials suitable for use as heater elements preferably have an angle of repose of 30-90 degrees.

In another aspect of the invention, conductors may be formed inside the boreholes at desired depths by using pile drivers. Hydraulic impact and/or vibrator pile divers may also be used in the construction of the in-situ liquefaction conductors.

Electric cables and buss bars are preferably provided for delivering power into the conductors that are preferably made of copper and/or aluminum alloys. Electric cable thickness preferably ranges between 0.2-2.0" ($5.2\times10^{-3}$-$5.08\times10^{-2}$ m).

Electric current to power in-situ liquefaction conductors is preferably 3-phase AC. A 3-phase AC current can be used to power the conductors when the distance from the transformers to the formation is in the range of 10-1,000 meters.

If 3-phase AC current is used, the system is preferably comprised of conductors connected in a Delta-connection pattern, with power going into them coming from a power supply. The power supply preferably receives power from the transformer energized by high voltage cables (via local AC current sourcing).

Alternatively, the electric current used to power the in-situ-liquefaction conductors may be DC. DC current may be used to power the conductors when the distance from the transformers to the formation is in the range of 5-700 meters.

If DC current is used, the system is preferably comprised of conductors connected in parallel with power going into them coming from a rectifier. The rectifier preferably receives power from a transformer energized by high voltage cables (via local AC current sourcing).

Resistive heating of subsurface formations preferably occurs within approximately 24 hr, The heat treatment time may range between 1-360 hours with heater spacing of 10 meters, 15 meters and/or 20 meters. The process preferably operates at voltages in the range from approximately 8,500 to 68,000V. In practice, the voltage needed to operate the process is: 10.8 Kv for conductors spaced 10 meters apart; 16.1 Kv for conductors spaced 15 meters apart from one another, and 21.5 Kv for conductor spacing of 20 meters, the electric current being applied in all cases for 24 hours. During heat treatment, the temperature of the tar sand formation is typically raised from about 15° C. to about 100° C.

DESCRIPTION OF THE DRAWINGS

FIG. 2(*b*) is a schematic drawing showing the supply of power to two pools in a tar sand formation using 3-phase AC power with the electrodes connected with a Delta configuration.

DETAILED DESCRIPTION OF THE INVENTION

The present invention provides a method of resistively heating subsurface formation from about 15° C. to approximately 100° C. At temperatures in excess of 85° C. the hydrocarbons will flow from the sandstone matrix and achieve sufficient fluidity to allow product recovery. The invention embodies the concept of supplying electrical current into subsurface formations by conducting electrical energy from the high voltage power supply above surface. The electrical current flows through the cables to the target formation. The insulated power cables have a short end of bare cable that preferably terminates in an electrode or a compacted column of conductive graphitic carbon. The electric cables and/or graphite electrodes are recoverable for reuse at a new site. A schematic of the concept is shown on FIG. 1

The proposed invention is an alternative to the SAGD process (Steam Assisted Gravity Drainage), in which steam at 250° C. is pumped down the boreholes. The known shortcomings of the SAGD process include the large amount of natural gas needed to create the steam that heats the formation and the amount of water consumed by the process. Canada, for instance, would likely be in violation of the Kyoto protocol of the United Nations if the currently planned development of the tar sands is pursued using the SAGD technique. Also, the recovery and treatment of the contaminated water that would result from the SAGD technique is a growing concern.

DESCRIPTION OF CONDUCTIVE MATERIALS

Preferably, graphitic, partially graphitized and non-graphitic granular and powdered carbonaceous materials (including electrodes) can be used as materials for the construction of in-situ liquefaction conductors Examples of materials include, but are not limited to:

a) Natural crystalline flake graphite
b) Partially graphitized cokes such as Desulco® 9001 (Superior Graphite Co., Chicago, Ill.), Resilient Graphitic Carbons (RGC grades), acetylene coke-based grades, fluid coke based grades
c) Calcined coke.
d) Green coke.
e) Brown and anthracite coal.
f) Carbon black and partially graphitized carbon black such as PUREBLACK® Carbon (available from Superior Graphite Co., Chicago, Ill.).
g) Synthetic, vein, amorphous graphite
h) Synthetic graphite electrodes and shapes
i) Coal Tar, petroleum and mesophase pitch—based chemistries
j) Expanded graphite-based products.

The conductors may be made of one or more of these materials.

In keeping with the invention, other conductive materials of non-carbonaceous nature may be used separately or in combination with one or more of the carbonaceous materials identified above. These may include: metals, metal-based alloys, composites and blends. Graphite electrodes may be connected with each other via metal male/female joining systems, in order to build retrievable in-situ conductors of sufficient strength and length.

DESCRIPTION OF CONDUCTION ELEMENTS

Figure 1:
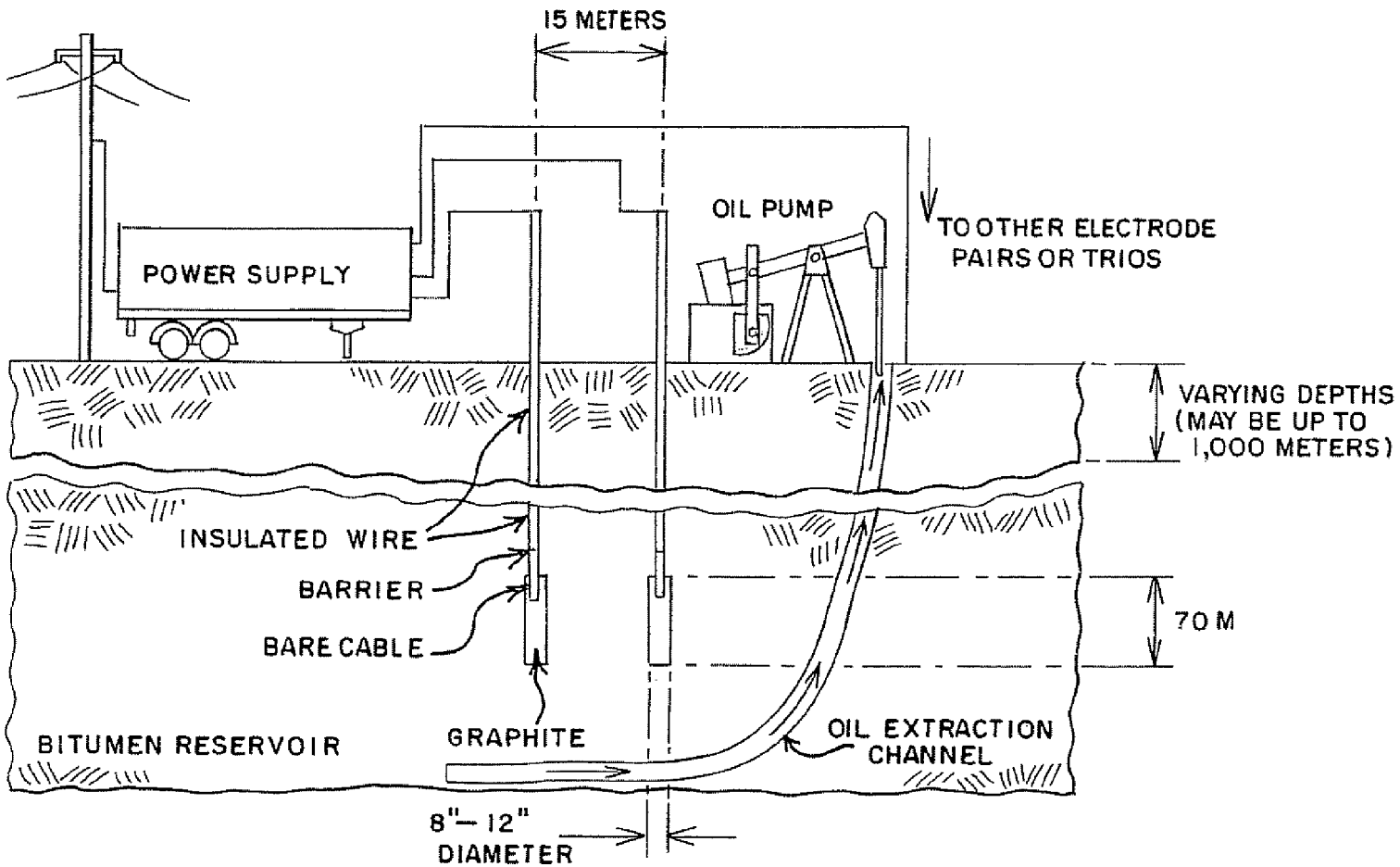
FIG. 1 is a schematic representation showing the resistive heating of a layer of a tar sand formation by supplying current to a bed of compacted graphite.

The system shown in FIG. 1 utilizes graphite-conductive elements. In keeping with one aspect of the invention, these elements can be made out of graphite electrodes, compacted granular or powdered carbon materials, or combinations thereof. The conductive element can be operational at depths of 70-100 meters. In certain circumstances the conductive element can produce heat.

In order to build conductors out of granular and/or powdered matter, the material needs to be compacted around a cable or a buss bar. The cable has to be insulated, except for a bare end imbedded in the graphite. In this application, in-situ liquefaction conductors may be formed from the compacted bed of powdered and/or granular graphitic carbon materials. Determinations of the proper diameter of the borehole and the contact of the conductor to the formation to insure adequate current flow are critical parameters. Generally, the bigger the diameter of the borehole, the greater the area that the heater can process and the higher the electric load which it can withstand. Typically, powdered or granular carbonaceous materials will form poor underground conductors for borehole diameters below 0.265" (0.67 cm) due to particle bridging as it is poured down the boreholes.

Figure 3:
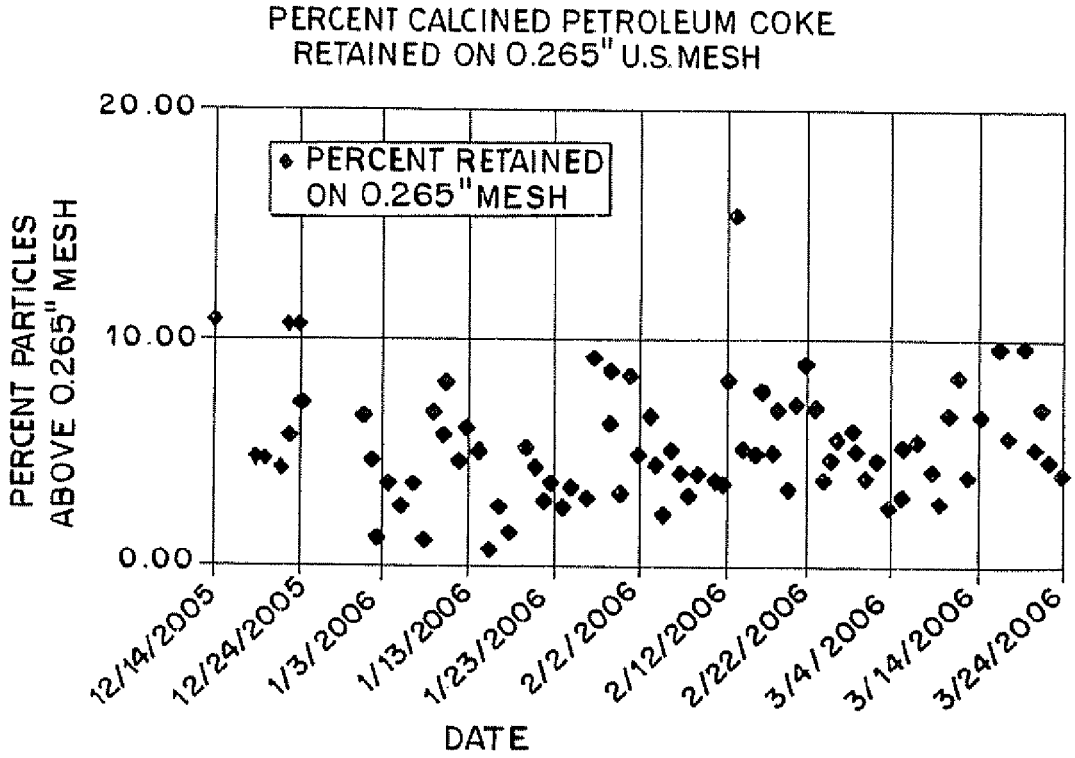
FIG. 3 is a graph showing the particle size characteristics of the calcined petroleum coke used in determining the borehole sizing.

Eighty-three experiments were conducted using a Ro-Tap sieve shaker to determine the minimum size of the borehole. Samples of calcined petroleum coke (CPC) were added to the top of stacked sieves, (CPC is used to produce Desulco, one of the specified materials for this application) The top sieve had ¾" (1.9 cm) openings while the second sieve had 0.265" (0.67 cm) openings. The stacks were placed in a Ro-Tap sieve shaker. The percentage by weight of each partitioned segment was determined. The data in FIG. 3 shows the average particle size spread. Up to 10 wt % of particles are +0.265"(0.67 cm), while 0 wt % of +¾" (1.9 cm) particles were identified in the size distribution. Therefore, where a product of such size distribution is used, the borehole could be as small as 0.265" (0.67 cm) in diameter. However, since drilling such small diameter boreholes can prove unrealistic and the minimum electric cable diameter has been determined, the minimum borehole size is preferably 1.5" (3.8 cm).

The maximum size of the boreholes is preferably 20". In the range of borehole diameters between 8-20", alternate material choices may include graphite electrodes (described below). These are significantly more conductive than compacted powders/granules; hence higher process efficiency is expected with electrode conductors.

When using granular/powdered graphite, carbon, and/or non-carbon-based materials for construction of in-situ liquefaction conductors, a technical issue arises on how to get these materials to the desired depths of near 30 meters below the surface reaching the hydrocarbon rich formations. The easiest way would be to pour these carbonaceous materials down pre-drilled boreholes to the desired depths. However, relatively small diameters of the boreholes claimed in this patent (3"-20", 7.6-50.8 cm) may present certain challenges, such as particle bridging. Thus, the angle of repose becomes a significant parameter when quantifying suitable powdered and/or granular carbonaceous materials for this application. The term "angle of repose" is a technical term for the slope which a granular and/or powdered material forms when it is at rest. The angle of repose can be quantified for different materials and is reported in degrees of the slope from the surface to vertical.

manufactured by KZK Powder Technology Corporation (Chantilly, Va.). The test is comprised of filling a clear plastic box with a sample and then opening a slide gate at the bottom of the fixture to allow the sample to freefall. The material accumulates, and a computer-controlled dial with straight parallel lines is adjusted to match the angle of the accumulation. Data from 15 samples is shown in Table 1 Samples designated 9020, 9018 and 9001 are commercial grades of purefied synthetic graphites (99.5% carbon), available from Superior Graphite Co. with 40%-65% sized smaller than 200 mesh, at least 95% sized smaller than 20 mesh, and at least 95% smaller than ⅜" and no more than 5% smaller than 70 mesh, respectively. Samples designated K0598 and K0898 are commercial grades of purefied flake graphite (98% carbon), available from Superior Graphite Co., with 85% larger than 50 mesh, and at least 80% larger than 80 mesh, respectively. All are sold under the trademark DESULCO. The range determined by these samples is 43 to 80 degrees but may be expanded to an include 30-90 degrees. The higher the angle of repose, the easier it is for conductive material to flow into the boreholes without bridging and clogging.

TABLE 1

Angle of Repose as a Function of Carbonaceous Material or Blend Composition.

| Experiment # | designation per Superior Graphite | Brief sample description | Angle of Repose |
|---|---|---|---|
| 1 | K0598 | natural cristalline flake graphite | 43 |
| 2 | 9001 (10 × 70 MESH) | partially graphitized calcined petroleum coke | 51 |
| 3 | 9020 | partially graphitized calcined petroleum coke | 59 |
| 4 | 9020/9018 (50/50) | two-component blend of partially graphitized calcined petroleum coke samples | 62 |
| 5 | 9020/K0598 (20/80) | blend of partially graphitized calcined petroleum coke with natural cristalline flake graphite | 60 |
| 6 | K0598(50%)/9018(25%)/9020(25%) | three-component blend of partially graphitized calcined petroleum cokes with natural cristalline flake graphite | 54 |
| 7 | K0598(75%)/9020(12.5%)/9001-10 × 70MESH-12.5%) | three-component blend of partially graphitized calcined petroleum cokes with natural cristalline flake graphite | 61 |
| 8 | K0598(80%)/9020(10%)/9001-10 × 70MESH-10%) | three-component blend of partially graphitized calcined petroleum cokes with natural cristalline flake graphite | 63 |
| 9 | 9020(50 wt %) + K0598 (50 wt %) | blend of partially graphitized calcined petroleum coke with natural cristalline flake graphite | 80 |
| 10 | K0598(80 wt %) + 20 wt % 9001(10 × 70mesh) | blend of partially graphitized calcined petroleum coke with natural cristalline flake graphite | 48 |
| 11 | K0598(70 wt %) + 30 wt % 9001(10 × 70mesh) | blend of partially graphitized calcined petroleum coke with natural cristalline flake graphite | 60 |
| 12 | K0598(50 wt %) + 50 wt % 9001(10 × 70mesh) | blend of partially graphitized calcined petroleum coke with natural cristalline flake graphite | 54 |
| 13 | K898 | natural cristalline flake graphite | 54 |
| 14 | 9001 (50 wt %) + K898 (50 wt %) | blend of partially graphitized calcined petroleum coke with natural cristalline flake graphite | 65 |
| 15 | 9001 (70 wt %) + K898 (30 wt %) | blend of partially graphitized calcined petroleum coke with natural cristalline flake graphite | 58 |

Experiments were designed to determine the range of angle of repose for several powdered carbonaceous materials considered as in-situ liquefaction conductors. The angle of repose has been determined using a Powder Testing Center In feeding conductive media into the boreholes to form in-situ liquefaction conductors at desired depths, a vibratory feeder may be utilized to aid in material flow. An example of such a feeder is the Solids Flow 7000 fibrous material feeder, available from Schenck AccuRate, (Whitewater, Wis.). The tendency of powders or granules to clump or bridge inside the borehole before reaching the desired depth is substantially overcome using such feeders.

Alternatively, pile drivers may also be used for enabling easier flow and compaction of subsurface conductors down the boreholes. There are two primary types of pile drivers applicable to this task hydraulic impact hammers and vibratory hammers. Typically, the total weight of the ram, anvil and hammer is 10,250 lbs. The typical diameter of the striking plate is 22.5"-2.5° (57.15-76.2 cm). While the impact hammer is effective, vibratory hammers are more common and have proven to be very efficient. Not only does use of a pile driver compress the graphite, it can also enhance particle packing to increase the conductivity of the heater. Data shows that hydraulic impact hammers can achieve only 4,350 psi, which may not always be enough to compress a heater in a formation, while a vibratory hammer (model 1,400VS manufactured by Hammer & Steel Company (St. Louis, Ill.)) can achieve 113,569 psi for a 3" (7.62 cm) diameter bore hole, which is sufficient for this application.

Figure 4:
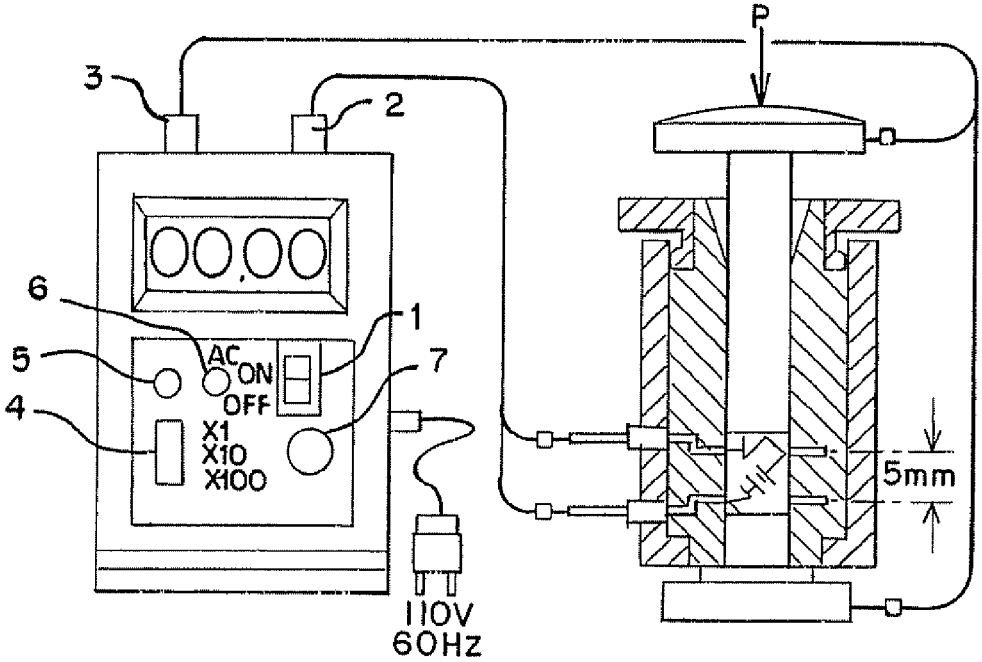
FIG. 4 is a schematic representation of a four-point resistivity tester

Specific resistance ranges for particulate use were evaluated. Results can be applied to graphite electrode applications as well. Conductivity is determined by the value of electrical resistance. Eighteen experiments were conducted as reported in Table 2. The tests were aimed to determine electrical resistivity as a function of compaction pressure using the 4-point resistivity tester, shown by FIG. 4.

TABLE 2

Electrical Resistivity (mΩ · m), as a function of pressure for some powdered and granular graphitic carbons.

| | | Compaction Pressure, PSI | | | | | |
|---|---|---|---|---|---|---|---|
| Example # | Sample description | 0 | 1063.7 | 5318.3 | 10636.4 | 15954.8 | 21273.1 |
| 1 | K0598 | 0 | 10.35 | 11.7 | 12.4 | 13.8 | 14.3 |
| 2 | 9001 | 0 | 3.45 | 2.99 | 3.68 | 3.91 | 4.14 |
| 3 | 9001 (10 × 70 MESH) | 0 | 2.53 | 7.59 | 8.5 | 8.28 | 9.43 |
| 4 | 9020 | 0 | 10.81 | 12.19 | 12.88 | 13.34 | 14.95 |
| 5 | 9020/9001 (50/50) | 0 | 2.3 | 5.3 | 5.98 | 7.36 | 8.05 |
| 6 | 9020/9018 (50/50) | 0 | 9.89 | 8.97 | 9.66 | 13.11 | 13.34 |
| 7 | 9018 | 0 | 10.35 | 11.27 | 12.42 | 12.42 | 13.8 |
| 8 | 9020/K0598 (20/80) | 0 | 16.1 | 17.48 | 18.17 | 18.4 | 18.6 |
| 9 | K0598(50%)/ 9018(25%)/9020 (25%) | 0 | 14.03 | 14.72 | 15.18 | 15.64 | 16.33 |
| 10 | K0598(75%)/9020(12.5%)/ 9001-10 × 70MESH-12.5%) | 0 | 11.73 | 11.96 | 13.34 | 14.26 | 14.49 |
| 11 | K0598(80%)/9020(10%)/ 9001-10 × 70MESH-10%) | 0 | 10.81 | 12.19 | 12.88 | 13.11 | 14.03 |
| 12 | 9020(50 wt %) + K0598(50 wt %) | 0 | 11.5 | 12.19 | 13.11 | 13.8 | 14.49 |
| 13 | K0598(80 wt %) + 20 wt % 9001(10 × 70mesh) | 0 | 8.05 | 8.51 | 9.2 | 9.89 | 12.65 |
| 14 | K0598(70 wt %) + 30 wt % 9001(10 × 70mesh) | 0 | 4.6 | 6.21 | 7.13 | 9.2 | 10.35 |
| 15 | K0598(50 wt %) + 50 wt % 9001(10 × 70mesh) | 0 | 6.21 | 6.67 | 6.44 | 8.05 | 9.66 |
| 16 | K898 | 0 | 9.2 | 10.12 | 11.27 | 11.73 | 12.42 |
| 17 | 9001 (50 wt %) + K898 (50 wt %) | 0 | 6.21 | 7.13 | 9.89 | 10.81 | 11.04 |
| 18 | 9001 (70 wt %) + K898 (30 wt %) | 0 | 5.75 | 9.2 | 9.89 | 10.81 | 11.27 |

Figure 5:
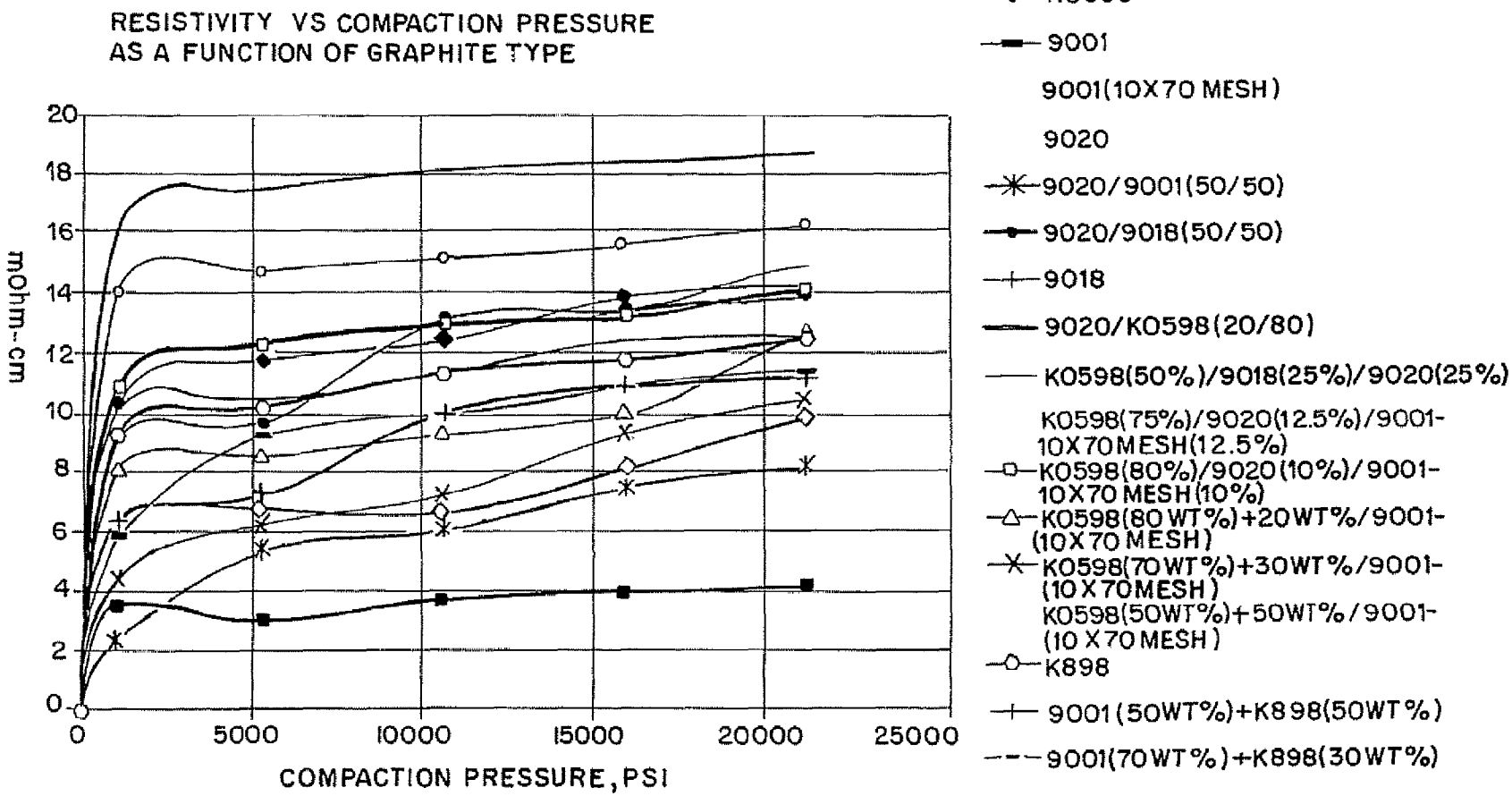
FIG. 5 is a graph showing electrical resistivity vs. compaction pressure as a function of the type of graphitic carbon.

Specific size fractions of samples (in the range of 2.5 to 3.5 g, depending on the material's volume) were confined under load in a non-conductive cylindrical mold by four metal electrodes. The two side electrodes were Nickel, while the top and bottom electrodes were stainless steel. Resistance was measured between these electrodes in FIG. 5. It is apparent that the range of electrical resistivities observed in experiments #1 through 18 (Table 3) covers the range of 3-19×$10^{-5}$ Ω·m. However, if graphite electrodes are used, their electrical resistivity is in the range of 7-20×$10^{-6}$ Ω·m. For the case of metals and commercial alloys, the resistivity values are in between 1-200×$10^{-8}$ Ω·m. Less conductive materials shall be of the order of 1×$10^{-3}$ Ω·m through 3×$10^{-5}$ Ω·m. Therefore, the range of electrical resistivity covered by this application is in the range of 1×$10^{-3}$ Ω·m through 1×$10^{-8}$ Ω·m.

Alternatively, in-situ liquefaction conductors can be made out of graphite electrodes. Graphite and carbon-based electrodes may include:

a) Graphitized electrodes, similar to electrodes for ladle metallurgy applications.

b) Electrodes based on coke with tar used as a binder.

The typical length of individual graphite electrode is more than 40" (1 m) and less than 200" (5 m). Graphite electrodes as conductors are more efficient with borehole outside diameters between 8-20" (20.3-50.8 cm). In order to build a heater assembly out of several graphite electrodes, the electrodes are arranged in a column and interconnected with graphite or metal (stainless steel, copper, bars, aluminum, etc.) nipples/connectors. Columns of electrodes as long as 100 meters and as short as 1 meter are contemplated in this application. Retrievable and reusable electrodes can be used if strong nipples/connectors are used for longer length assemblies.

In-situ liquefaction conductors made of graphitized electrodes having an OD smaller than the diameter of the borehole may be used in conjunction with particulate graphite packed in the remaining space. Thus, a heater can be made in a 12" hole, with a 10" electrode with graphite packing on the outside. Among the advantages of such a design are: improved conductivity, better contact with the porous formation, higher mechanical stability, higher current densities, and ease of retrieval.

Description of Electrical Requirements

Power demands on industrial system such, as in-situ liquefaction conductors, can be substantial. Buss bar and cable calculations are provided to determine minimum diameter needed, assuming the cross section is round, with an OD of the actual metal feed conductor (excluding insulation) marked as d.

The area (S) of the circular conductor shall be:

$$S = \frac{\pi \cdot d^2}{4};$$

Knowing that S can also be represented as:

$$S = \frac{\rho \cdot \ell \cdot I}{U} = \frac{\pi \cdot d^2}{4};$$

Where:

ρ—Electrical resistivity l—Length of a cable

I—Current flowing through the cable, measured in amps, A.

U—Voltage, V.

Solving this equation for d, one will get:

$$d = 1.128\sqrt{\frac{\rho \cdot \ell \cdot I}{U}};$$

Practical metals for construction of electric cables and buss bars are Copper and/or Aluminum alloys. Values of their electrical resistivity are shown in Table 3.

TABLE 3

Electrical Resistivity vs Calculated Minimum Diameter of Metal Conductors.

| Metal | Electrical resistivity, $10^{-8}$, $\Omega \cdot m$ | Minimum diameter, d, $10^{-3}$, m |
|---|---|---|
| Copper | 1.7 | 5.2 |
| Aluminum alloy 3003, rolled | 3.7 | 7.8 |
| Aluminum alloy 2014, annealed | 3.4 | 7.5 |
| Aluminum alloy 360 | 7.5 | 11.0 |

Reduced to practice, flexible conduit measuring ¾"—up to rigid, 2" in OD would be used to comply with local electric codes. Therefore, the range of the metal part of cable thickness claimed herein is $5.2\times10^{-3}$ meters (0.2") through $5.08\times10^{-2}$ meters (2.0").

Two primary types of current would be applicable for this system: 3-phase AC and DC. Formations to be heated may be located at varying depths down to 1,000 meters below the surface. The depth of formation may be one of the guiding factors in which type of electrical system may be used.

It is generally accepted that AC current is capable of delivering higher voltage than DC. AC currents are the preferred choice if there are large travel distances from the power source to an object being heated. Three-phase AC current can be used to power underground conductors composed, in part, of carbonaceous materials, when the distance between the transformers to the object being heated is in the range of 10-1,000 meters. For AC applications (FIG. 6 (*b*)), the system is comprised of conductors (R) connected in Delta connection pattern in order to make each circuit independent, with power going into it coming from the power supply (3), which is receiving its power from the transformer (1), which is in turn, receiving its input from the high voltage cables (power line of the electric company, typically AC current, carrying 161,000 V).

In contrast, DC is capable of delivering smaller amperage at very high voltages. Such currents are viewed to be most efficient for distances between 5-700 meters. A DC current would be preferred for short distances between transformers and a formation to be heated. For DC applications (FIG. 6 (*a*)), the system shall be comprised of conductors (R) connected in parallel, with power going into it coming from a rectifier (2), which is receiving its power from the transformer (1), which is in turn, receiving its input from the high voltage cables (power line of the electric company). The later is typically AC current, carrying 161,000 V.

Figure 6A:
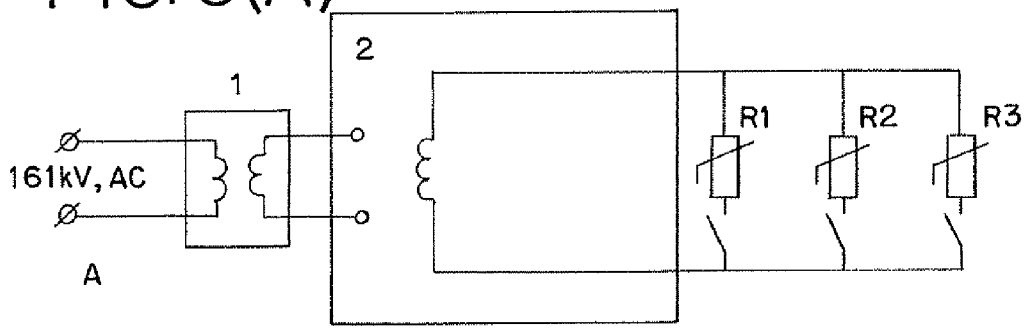
FIGS. 6(A) and (B) are sample electric circuits for DC and Delta-connection 3-phase AC, respectively.
Figure 6B:
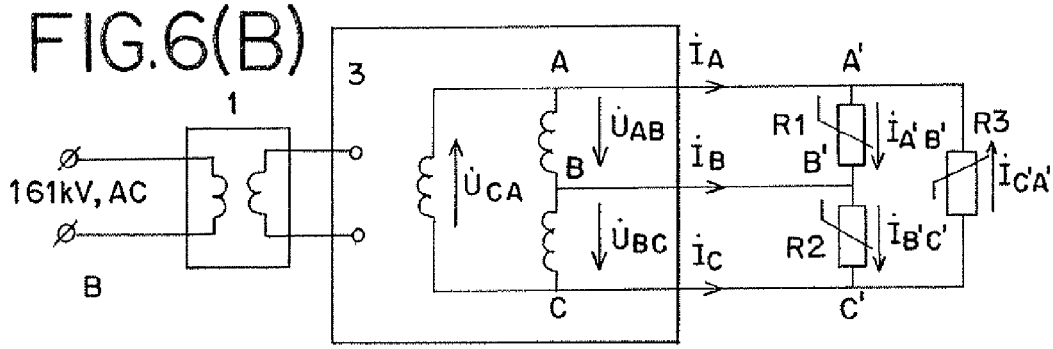

The principal electric circuits for a combination of DC (FIG. 6 (*a*)) and 3-phase AC (FIG. 6 (*b*)) can also be used. The systems shown have in-situ liquefaction conductors identified as resistances R1 through R3 (3 conductors connected at the same time is shown, while the application is not limited to this case).

Description of Energy Consumption and Heat Treatment Duration

Figure 2A:
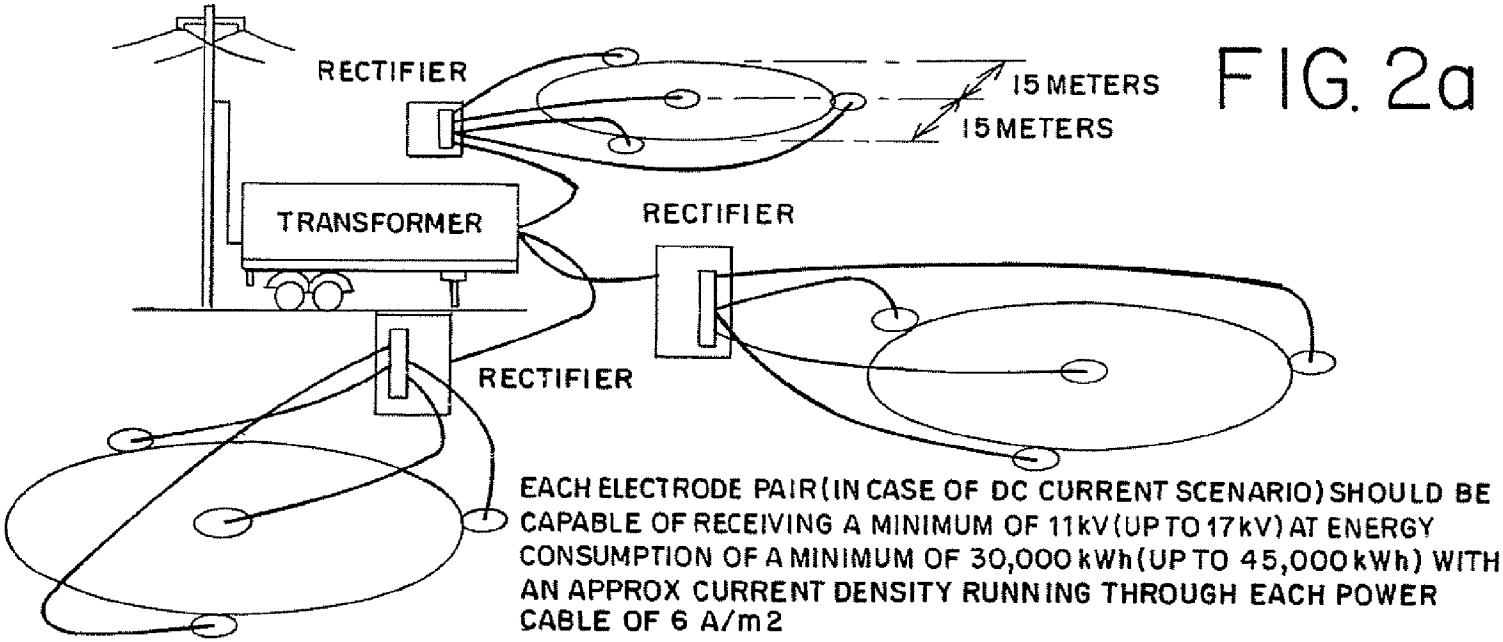
FIG. 2(*a*) is a schematic drawing showing the supply of power to three separate pools and a tar sand formation using direct current (DC).
Figure 2B:
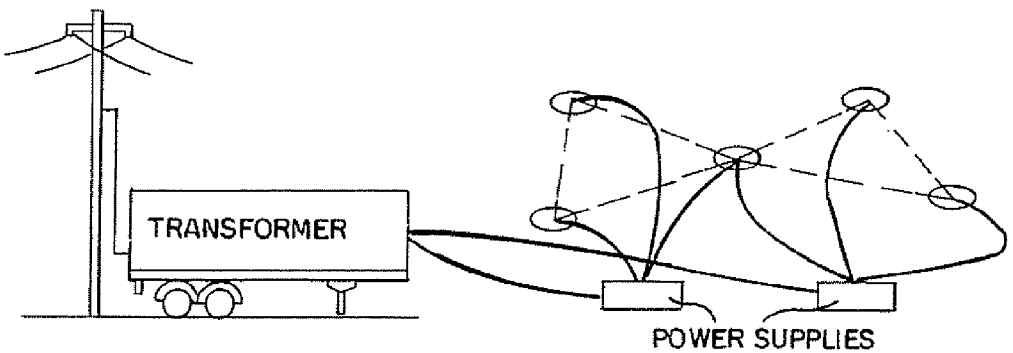

FIG. 2 offers one suggested design of DC current heater placement in an area where the deposit of tar sand formation is situated. This heater placement design is represented by an imaginary circle with a center electrode of a greater diameter than the ones on the outside curve of the circle. The center electrode serves a single terminal for at least 3 other electrodes of a counter polarity.

The following basic data is used in the design. Borehole diameter—12' (30.5 cm); Hole depth—230 ft (70 m); estimated oil content in the tar sands—1.572 bbl/$m^3$, assuming that tar sands formation has porosity of 30%; 5% is water and 25% oil. Thus, 1 $m^3$ of formation will contain 0.25 $m^3$ of oil. From here, 0.25 $m^3$ oil×35 31 $ft^3/m^3$ (density of oil)×1 bbl/5.5646 $ft^3$ (conversion factor of bbl/$ft^3$ into bbl/$m^3$)=1.572 bbl oil/$m^3$. Per FIG. 2, one of the preferred electrode placement designs is circular (30 meter diameter, or 49,480.1 $m^3$ in total volume, or, less electrode hole volume is 49,459.7 $m^3$ in usable volume). This design features a single center electrode and three more on the peripheries (4 holes altogether) with a recovery rate of 20%. An estimated 15,556 barrels of recoverable hydrocarbons may be produced from such a geometry.

Obviously, electrode placement can vary, and one alternative is a simple placement of two electrodes (a single "–" and a single "+" configuration), with electrodes located at opposite ends. This pattern of electrode placement is represented in FIGS. 1 and 2(*a*). Calculations contained herein refer to the later electrode placement.

Energy Needed to Heat 1 $m^3$ of Formation

The electrical energy needed to heat 1 $m^3$ of formation assuming no loses to the outside from a direct line between the two electrodes can be calculated using the equation.

$$E_1=C\times V\times(T2-T1), \quad (1)$$

Where:

$E_1$—energy measured in kJ in this particular case.

V—effective volume of the formation in $m^3$.

T2—target temperature (100 deg C. in our case)

T1—initial formation temperature (15 deg C. in our case)

C—coefficient of thermal capacity for the bitumen formation, taken from literature, which is a calculated value of 2,280 kJ/($m^3$×C)=0.6333 kW*hr/($m^3$*C).

One cubic meter of formation shall have a weight of 1000 kg/0.832 $m^3$=1,201.92 kg/$m^3$.

Thus, $$E_1=2{,}280\ \text{kJ}/(\text{m}^3\times\text{C})\times 1\ \text{m}^3\times(100\ \text{C}-15\ \text{C})=193{,}800\ \text{kJ}=53.83\ \text{kWh}$$

This value alone cannot be used in calculating the costs or the voltages needed to run the process of oil extraction. The reason being is that thermal energy losses need to add to the equation.

Energy Loss Heating 1 $m^3$ of Formation

We assume that energy is lost in six directions from the imaginary cube of rock heated by 2 electrodes. Energy loss due to heat transfer (Q) in one direction can be presented as:

$$Q=\lambda\cdot t\cdot A\int_{15}^{100}\frac{dT}{dL}; \quad (2)$$

Where:

λ—Thermal conductivity of formation (in our case it is 3.1 Watts/(m*C)).

t—Time, measured in seconds.

dT—Temperature gradient (in a simplistic case without a need for solving an integral it is 85 C).

A—Cross section area of an imaginary cube measuring 1 $m^3$ (this cube may have 10 m between the two electrodes and walls of the cube.)

Energy spent on heat losses into the formation, when heating 1 $m^3$ of bitumen within 11 days will be:

$$Q=4\times3.1\times24\times11\times85\times10\times0.317/0.5+2\times3.1\times24\times11\times85\times0.317\times0317/0.5=1{,}792.1\ \text{kWh}.$$

Overall, for the ΔT=85 C the equation of total required energy can be written as (3):

$$E=E_1+Q=53{,}830+6{,}788.28\times t \quad (3)$$

Total Energy Needed Heating 1 $m^3$ of the Formation

The energy to heat the formation ($E_1$, see equation 1) and energy losses due to heat transfer (Q, see equation 2), have to be added to form the following equation for total energy consumption (E):

$$E=E_1+Q=U\times I\times t, \quad (4)$$

Where:

U—Voltage, (electrodes dug in the ground)

I—Current, A, t—Time, hr.

For future reference, (4) can be solved for 1 as equation (4a) (it will be used later in Table 4):

$$I=\frac{E}{U\cdot t}; \quad (4a)$$

Knowing that U=I×R, and $$R=\rho\cdot\frac{\ell}{S},$$

where ρ is value of specific resistance of formation (in our case it is 200 Ohm*m); l—distance between the electrodes; S—electrode cross-section area, $m^2$. In which case, (4) can be re-written as:

$$E=E_1+Q=U^2/R\times t; \quad (5)$$

Or, solving it for U, one can obtain:

$$U=\sqrt{\rho\cdot\ell\left(2\lambda\cdot\int_{T1}^{T2}\frac{dT}{dL}+\frac{C\cdot V\cdot(T2-T1)+4\lambda\cdot A\cdot t\cdot\int_{T1}^{T2}\frac{dT}{dL}}{t\cdot S}\right)}; \quad (6)$$

Basically, the values in the above equation are known, except for three: U—voltage to be applied to the electrodes (measured in V); t—time to heat the formation to extract oil (measured in hours), and l—distance between the electrodes (measured in meters).

For simplicity of calculation, let us consider that $$\int_{T1}^{T2}\frac{dT}{dL}=\frac{T2-T1}{L};$$

We earlier said that L=0.5 m. If so, equation (6) may be simplified to (7):

$$U=\sqrt{\frac{\rho\cdot\ell\cdot(T2-T1)}{L}\cdot\left(2\lambda+4\frac{\lambda\cdot A}{S}+\frac{C\cdot V\cdot L}{t\cdot S}\right)}; \quad (7)$$

Design Models

Example 1

Hydrocarbons are extracted from 1 $m^3$ of formation with electrodes 10 meters apart while varying heat treatment time.

Solving equation (7) with l=10 m, shall lead to the following formula (8).

$$U = 583.1\sqrt{399.3 + \frac{3166.5}{t}}; \quad (8)$$

Table 4 presents results of calculations of U as a function of t, as well as derivative energy and costs calculations.

TABLE 4

Calculated processing parameters vs estimated energy costs for the heat treatment process.

| Sample heat treatment time of 1 $m^3$ of formation, hrs | Sample heat treatment time of 1 m3 of formation, days | Required voltage to perform operation, V | Required Energy Supply need, E, kWh (calculated per equation (3)) | Current density, A/$m^2$ (calculated using equation (4) and area of 0.1 m2 used above) |
|---|---|---|---|---|
| 1 | 0.042 | 34,818 | 60.6 | 17.5 |
| 24 | 1 | 13,439.4 | 216.8 | 6.7 |
| 240 | 10 | 11,840.4 | 1,683 | 5.9 |
| 264 | 11 | 11,823.2 | 1,845.9 | 5.9 |
| 720 | 30 | 11,715.8 | 4,941.4 | 5.86 |

Example 2

Hydrocarbons are extracted using two 12" (0.305 m) electrodes, 70 meters deep 10 meters apart while varying heat treatment time. The volume between the two electrodes is 213.5 $m^3$.

Solving equations (5) and (7) will result in the following formula:

$$E=Q+E_1=763.52t+11,492.7;$$

TABLE 5

Calculated processing parameters vs. estimated energy requirement for the heat treatment process.

| Heat treatment time of 213.5 $m^3$ of formation, hrs | Heat treatment time, days | Required voltage to perform operation, V | Required Energy Supply need, E, kWh (calculated per equation (3)) | Current density, A/$m^2$ (calculated using equation (4) and electrode area used above) | Energy requirement per barrel of oil, kWh/bbl |
|---|---|---|---|---|---|
| 1 | 0.042 | 33,884 | 12,256 | 16.9 | 36.6 |
| 24 | 1 | 10,788.1 | 29,817.2 | 5.4 | 88.9 |
| 240 | 10 | 8,718.4 | 194,737.5 | 4.4 | 580.5 |
| 264 | 11 | 8,694.9 | 213,061.3 | 4.3 | 635.2 |

Example 3

Hydrocarbons are extracted using two 12" (0.305 m) electrodes, 70 meters deep, 15 meters apart while varying heat treatment time and assuming 100% yield of oil. The volume between the two electrodes is 320.25 $m^3$.

Solving equations (5) and (7) will result in the following formula:

$$E=Q+E_1=1,135.6t+17,239;$$

TABLE 6

Calculated processing parameters vs estimated energy costs for the heat treatment process.

| Heat treatment time of 320.25 $m^3$ of formation, hrs | Heat treatment time, days | Required voltage to perform operation, V | Required Energy Supply need, E, kWh (calculated per equation (3)) | Current density, $A/m^2$ (calculated using equation (4) and electrode area used above) | Energy requirement per barrel of oil, kWh/bbl |
|---|---|---|---|---|---|
| 1 | 0.042 | 50,811.6 | 18,374 | 16.9 | 36.5 |
| 24 | 1 | 16,139.9 | 44,493 | 5.37 | 88.4 |
| 120 | 5 | 13,407.3 | 153,511 | 4.47 | 305.1 |
| 240 | 10 | 13,016.1 | 289,639 | 4.3 | 575.7 |

Example 4

Hydrocarbons are extracted using two 12" (0.305 m) electrodes, 70 meters deep, 20 meters apart while varying heat treatment time and assuming 100% yield of oil. The volume between the two electrodes is 427 $m^3$.

Solving equations (5) and (7) will result in the following formula:

$$E=Q+E_1=1{,}504.5t+22{,}985.4;$$

TABLE 7

Calculated processing parameters vs estimated energy costs for the heat treatment process.

| Heat treatment time of 427 $m^3$ of formation, hrs | Heat treatment time, days | Required voltage to perform operation, V | Required Energy Supply need, E, kWh (calculated per equation (3)) | Current density, $A/m^2$ (calculated using equation (4) and electrode area used above) | Energy requirement per barrel of oil, kWh/bbl |
|---|---|---|---|---|---|
| 1 | 0.042 | 67,736.8 | 24,489.9 | 16.9 | 36.5 |
| 24 | 1 | 21,478.1 | 59,093.4 | 5.37 | 88 |
| 240 | 10 | 17,315.2 | 384,065.4 | 4.3 | 572.1 |

Heat Treatment Duration

Figure 7:
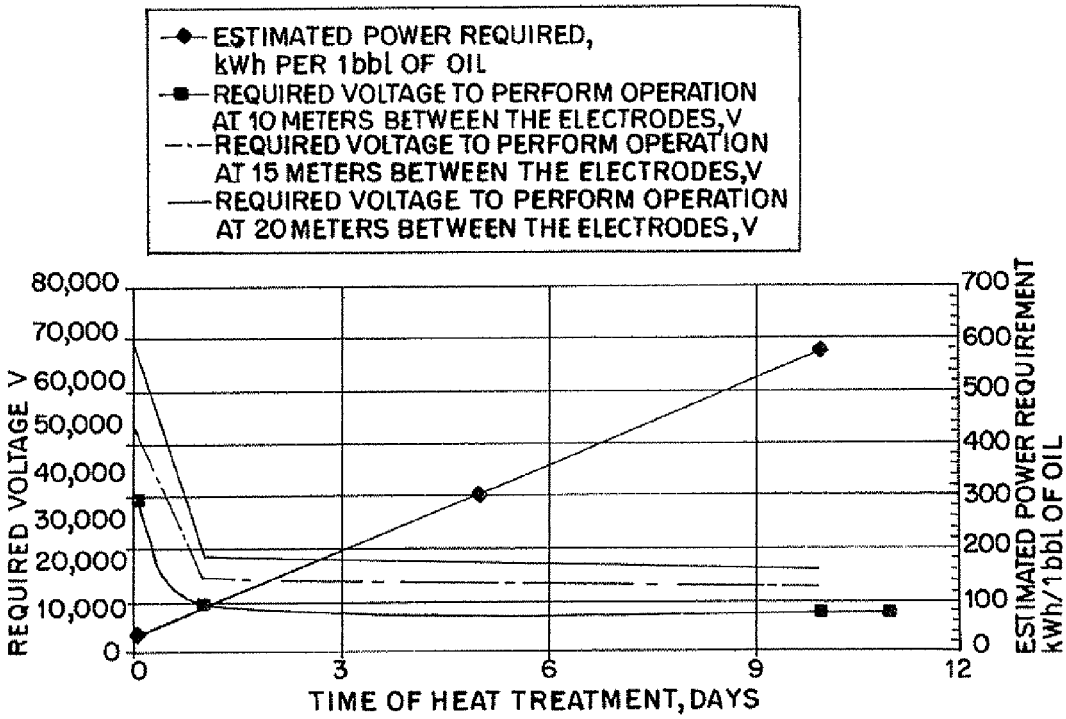
FIG. 7 is a graph showing the estimated power consumption vs. required process voltage vs the length of heat treatment time for various distances between the electrodes.

FIG. 7 shows the process voltage vs. duration of heat treatment for various distances between the conductors. The objective is to identify an optimum operational range and energy to recover 1 bbl of oil.

The results show that the most favorable operational range for a heat treatment of 24 hours being: a voltage of 10.8 kV for conductors placed 10 meters apart; 16.1 kV for conductors spaced 15 meters apart, and 21.5 kV for spacing of 20 meters.

CONCLUSION

Thus, a method has been provided for extracting oil from tar sands using resistive heating. While the invention has been described in terms of certain preferred embodiments, there is no intent to limit it to the same. Instead, the invention is to be defined by the scope of the following claims.

The invention claimed is:

1. A method for heating a sub-surface tar sand formation comprising:

making a plurality of boreholes into the tar sand formation;

pouring dry powdered or granular graphite into the boreholes;

embedding an end of an electrical conductor in the graphite in each borehole;

compacting the graphite around the end of the electrical conductor in each borehole, conductively connecting the electrical conductors to a source of electrical current; and introducing electrical current to the conductors to resistively heat the tar sand formation.

2. The method of claim 1 wherein the electrical conductors comprise electrodes.

3. The method of claim 2 wherein the electrical conductors are formed from one or more carbonaceous material selected from the group consisting of graphitic, partially graphitized, and non-graphitic carbonaceous materials.

4. The method of claim 2 wherein the electrical conductors are formed from one or more materials selected from the group consisting of natural crystalline flake graphite, partially graphitized cokes, calcined coke, green coke, coal, carbon black, synthetic graphite, vein graphite, amorphous graphite, synthetic graphite electrodes, coal tar, petroleum and mesophase pitch-based chemistries, and expanded graphite-based products.

5. The method of claim 4 wherein the conductive material has an angle of repose of from 30 degrees to 90 degrees.

6. The method of claim 2 wherein the electrical conductors are formed from one or more non-carbonaceous conductive material selected from the group consisting of metals, metal-based alloys, composites, and blends and combinations thereof.

7. The method of claim 2 wherein the electrodes have a diameter smaller than the borehole and the electrodes, when located in their respective boreholes, are surrounded by a granular or powdered conductive material.

8. The method of claim 1 wherein the electrical conductors have a resistance of from $1\times10^{-3}$ Ω·m to $1\times10^{-8}$ Ω·m.

9. The method of claim 1 wherein the boreholes have a diameter of from approximately 3.8 cm to approximately 50.8 cm.

10. The method of claim 1 wherein the conductors are formed inside the boreholes using a pile driver.

11. The method of claim 1 wherein the electric current is 3-phase AC.

12. The method of claim 1 wherein the electric current is DC.

13. A system for heating a sub-surface tar sand formation comprising:

a plurality of boreholes in the tar sand formation;

an electrical conductor in each borehole formed from a compacted bed of dry powdered or granular conductive material; and a source of electrical current conductively connected to the conductors.

14. The system of claim 13 wherein the electrical conductors comprise electrodes.

15. The system of claim 14 wherein the electrical conductors are formed from one or more carbonaceous material selected from the group consisting of graphitic, partially graphitized, and non-graphitic carbonaceous materials.

16. The system of claim 14 wherein the electrical conductors are formed from one or more materials selected from the group consisting of natural crystalline flake graphite, partially graphitized cokes, calcined coke, green coke, coal, carbon black, synthetic graphite, vein graphite, amorphous graphite, synthetic graphite electrodes, coal tar, petroleum and mesophase pitch-based chemistries, and expanded graphite-based products.

17. The system of claim 16 wherein the conductive material has an angle of repose of from 30 degrees to 90 degrees.

18. The system of claim 14 wherein the electrical conductors are formed from one or more non-carbonaceous conductive material selected from the group consisting of metals, metal-based alloys, composites, and blends and combinations thereof.

19. The system of claim 14 wherein the electrodes have a diameter smaller than the borehole and the electrodes, when located in their respective boreholes, are surrounded by a granular or powered conductive material.

20. The system of claim 13 wherein the electrical conductors have a resistance of from $1\times10^{-3}$ Ω·m to $1\times10^{-8}$ Ω·m.

21. The system of claim 13 wherein the boreholes have a diameter of from approximately 3.8 cm to approximately 50.8 cm.

22. The system of claim 13 wherein the electric current is 3-phase AC.

23. The system of claim 13 wherein the electric current is DC.

24. A method for heating a sub-surface tar sand formation comprising:

making a plurality of boreholes into the tar sand formation;

forming an electrical conductor in each borehole from a compacted bed of powdered or granular conductive material using a pile driver;

conductively connecting the electrical conductors to a source of electrical current; and introducing electrical current to the conductors to resistively heat the tar sand formation.

* * * * *

UNITED STATES PATENT AND TRADEMARK OFFICE

CERTIFICATE OF CORRECTION

PATENT NO. : 7,617,869 B2
APPLICATION NO. : 11/671135
DATED : November 17, 2009
INVENTOR(S) : Peter R. Carney et al.

It is certified that error appears in the above-identified patent and that said Letters Patent is hereby corrected as shown below:

On the Title Page, Item (75) Inventors reading "Frank Wawzros" should read --Frank Wawrzos--

Signed and Sealed this

Twelfth Day of October, 2010

David J. Kappos

David J. Kappos
*Director of the United States Patent and Trademark Office*